US007730650B1

(12) United States Patent
Barnhill

(10) Patent No.: US 7,730,650 B1
(45) Date of Patent: Jun. 8, 2010

(54) LOADER BUCKET ATTACHMENT APPARATUS

(76) Inventor: Wade D. Barnhill, 17525 NW. 240th St., Okeechobee, FL (US) 34972

( * ) Notice: Subject to any disclaimer, the term of this patent is extended or adjusted under 35 U.S.C. 154(b) by 0 days.

(21) Appl. No.: 12/423,744

(22) Filed: Apr. 14, 2009

(51) Int. Cl.
*E02F 3/40* (2006.01)

(52) U.S. Cl. ..... 37/444

(58) Field of Classification Search ..... 37/403–410, 37/444, 466, 468, 184–188, 903; 414/722, 414/723, 726
See application file for complete search history.

(56) References Cited

U.S. PATENT DOCUMENTS 3,985,249 A 10/1976 Aker et al.
4,127,203 A 11/1978 Arnold
4,133,121 A 1/1979 Hemphill
4,187,050 A 2/1980 Barbee
4,304,058 A 12/1981 Schwappach
4,400,898 A * 8/1983 Christensen et al. ..... 37/444
4,459,768 A * 7/1984 Albrecht ..... 37/444
6,422,805 B1 7/2002 Miller
D565,062 S 3/2008 Miller et al.

* cited by examiner

*Primary Examiner*—Robert E Pezzuto
(74) *Attorney, Agent, or Firm*—Crossley Patent Law; Mark Ashley Crossley

(57) ABSTRACT

The excavator bucket attachment apparatus provides an improved attachment of an existing excavator bucket to the existing lift arm and hydraulic cylinder. The apparatus replaces a plurality of attachment components, including 4 attachment pins, with a more basic assembly that saves considerable parts cost and labor in maintenance of a bucket attachment. The apparatus further provides a method of conversion of an existing bucket attachment to the present apparatus.

3 Claims, 4 Drawing Sheets

LOADER BUCKET ATTACHMENT APPARATUS

BACKGROUND OF THE INVENTION

Buckets, such as those attached to excavators, are typically attached via a plurality of parts. Typically the parts include two upper pins with retainers and bushings, two lower pins with bushings, an H-member, and other related parts. Upkeep involves maintenance of these existing parts and, periodically, parts replacement, which obviously includes labor time and costs, along with machine down time. This will clearly result in significant savings. The present apparatus provides a modification to the attachment of a bucket to the lift arm and hydraulic cylinder of such machinery that reduces the number of parts several-fold and thereby reduces parts and labor to only a fraction of what is normally incurred.

FIELD OF THE INVENTION

The excavator bucket attachment apparatus relates to bucket excavators and more especially to a modification of the bucket mount to the hydraulic cylinder and lift arm that improves the connection between the two to save parts, labor, and maintenance costs.

SUMMARY OF THE INVENTION

The general purpose of the excavator bucket attachment apparatus, described subsequently in greater detail, is to provide an excavator bucket attachment apparatus which has many novel features that result in an improved excavator bucket attachment apparatus which is not anticipated, rendered obvious, suggested, or even implied by prior art, either alone or in combination thereof.

To attain this, the excavator bucket attachment apparatus provides for converting an attachment of an excavator bucket to a lift arm and hydraulic cylinder to a more cost efficient attachment. The apparatus also provides for inclusion as an original manufacturers attachment. In both cases, the currently existing attachments use many parts that can be omitted with the present apparatus. Currently used bucket attachments provide at least 4 pivotal pin assemblies, along with two arms that are commonly referred to as dog bones, the dog bones attached as part of the upper 2 pins of the assemblies.

Current attachments also include an H-member, along with retainers and fasteners. Regular maintenance and parts replacement is involved and must be accompanied with significant labor costs, comparatively. The present apparatus excludes many of the parts by simplifying the attachment of the bucket to the lift arm and the hydraulic cylinder of an excavator. The present apparatus needs only 2 pins, with one pin and its related bushings ideally being enlarged for added strength. The pins, dog bones, H-member, and related attachment hardware of an existing bucket attachment are removed. The side members of the present apparatus are welded to the existing bucket extensions. It is important to note that the side members of the apparatus are not limited in shape to only those as illustrated. Side members are provided in various shapes to fit various brands of buckets and bucket extensions of a plurality of excavator types. Ideally, but not required, the existing lift arm bushings are removed and replaced with enlarged bushings. The orifices in the existing bucket extensions are enlarged. The external enlarged bushings optionally included in the apparatus are fitted, and the new enlarged lower pin is fitted to pivotally attach the bucket to the lift arm. If the apparatus is fitted as original equipment, the lift arm may be strengthened and enlarged as chosen at its lower end. Further, the bucket extensions are modified to include the needed side members. The existing cylinder sleeve of the existing hydraulic cylinder, with bushing, is fitted between the orifices of the apparatus side members, and the upper pin is installed. With the apparatus, whether fitted as original equipment or retrofitted, scheduled maintenance is much more basic. Parts replacement is also greatly reduced.

While the illustrations depict a typical apparatus application, other forms of side members and bucket attachments are provided, each having a pair of spaced apart pivotal bucket attachments, one fore and one aft. Each uses a 2-pin design wherein one pin pivotally attaches the bucket to the lift arm of an excavator and the second pin pivotally attaches the bucket to the hydraulic cylinder of the excavator, one pin positioned rearwardly on the bucket, one pin positioned more forwardly on the bucket.

Thus has been broadly outlined the more important features of the improved excavator bucket attachment apparatus so that the detailed description thereof that follows may be better understood and in order that the present contribution to the art may be better appreciated.

An object of the excavator bucket attachment apparatus is to simplify the pivotal attachment between a bucket and the hydraulic cylinder and lift arm of a excavator.

Another object of the excavator bucket attachment apparatus is to save maintenance costs in labor and parts.

A further object of the excavator bucket attachment apparatus is to save on original parts costs.

And, an object of the excavator bucket attachment apparatus is to retrofit to an existing excavator with minimal labor and parts cost.

These together with additional objects, features and advantages of the improved excavator bucket attachment apparatus will be readily apparent to those of ordinary skill in the art upon reading the following detailed description of presently preferred, but nonetheless illustrative, embodiments of the improved excavator bucket attachment apparatus when taken in conjunction with the accompanying drawings.

In this respect, before explaining the current embodiments of the improved in detail, it is to be understood that the excavator bucket attachment apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved excavator bucket attachment apparatus. It is therefore important that the claims be regarded as including such equivalent constructions insofar as they do not depart from the spirit and scope of the excavator bucket attachment apparatus. It is also to be understood that the phraseology and terminology employed herein are for purposes of description and should not be regarded as limiting.

DETAILED DESCRIPTION OF THE DRAWINGS

Figure 1:
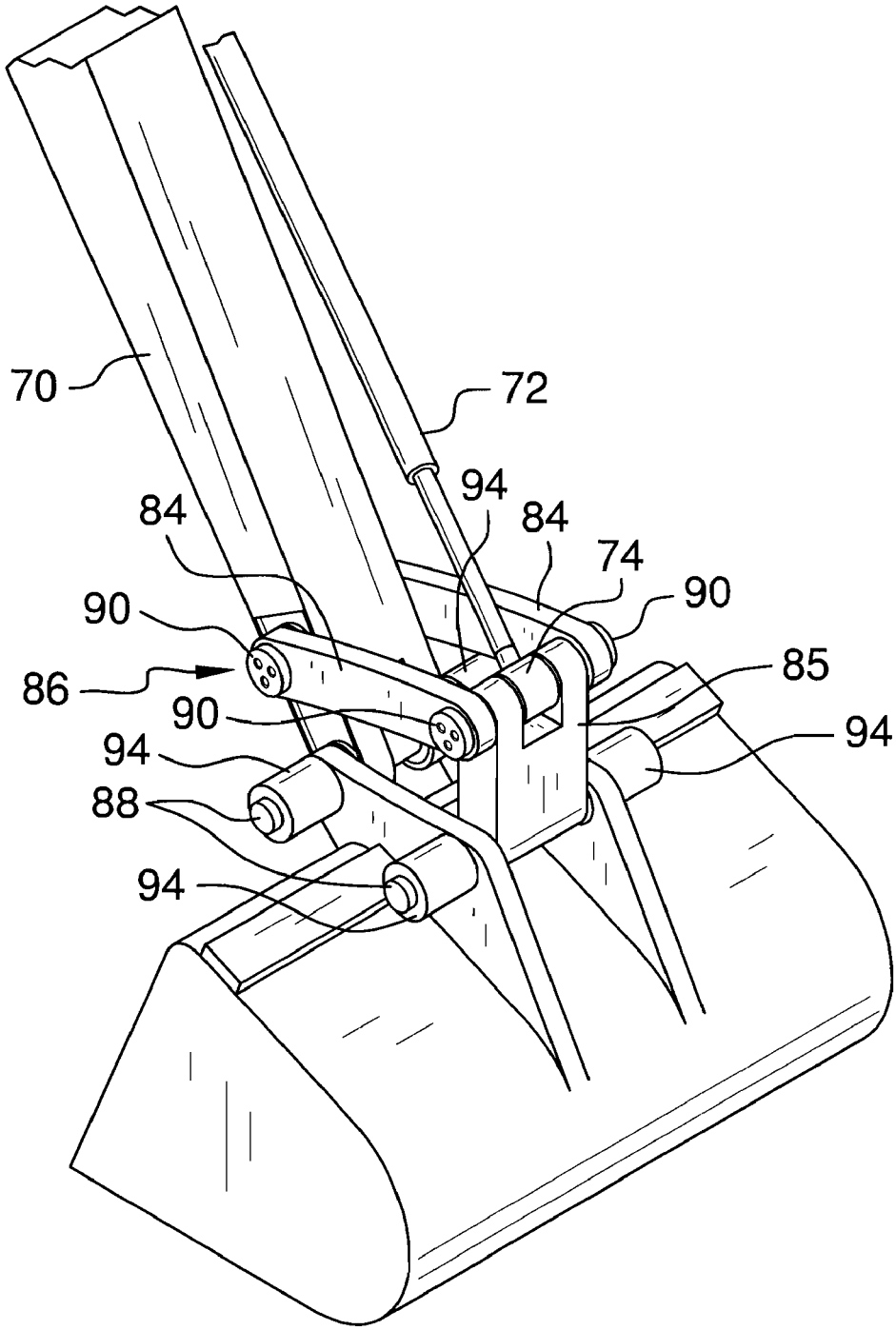
FIG. 1 is a perspective view of an existing lift arm and hydraulic cylinder attachment to a bucket.
Figure 2:
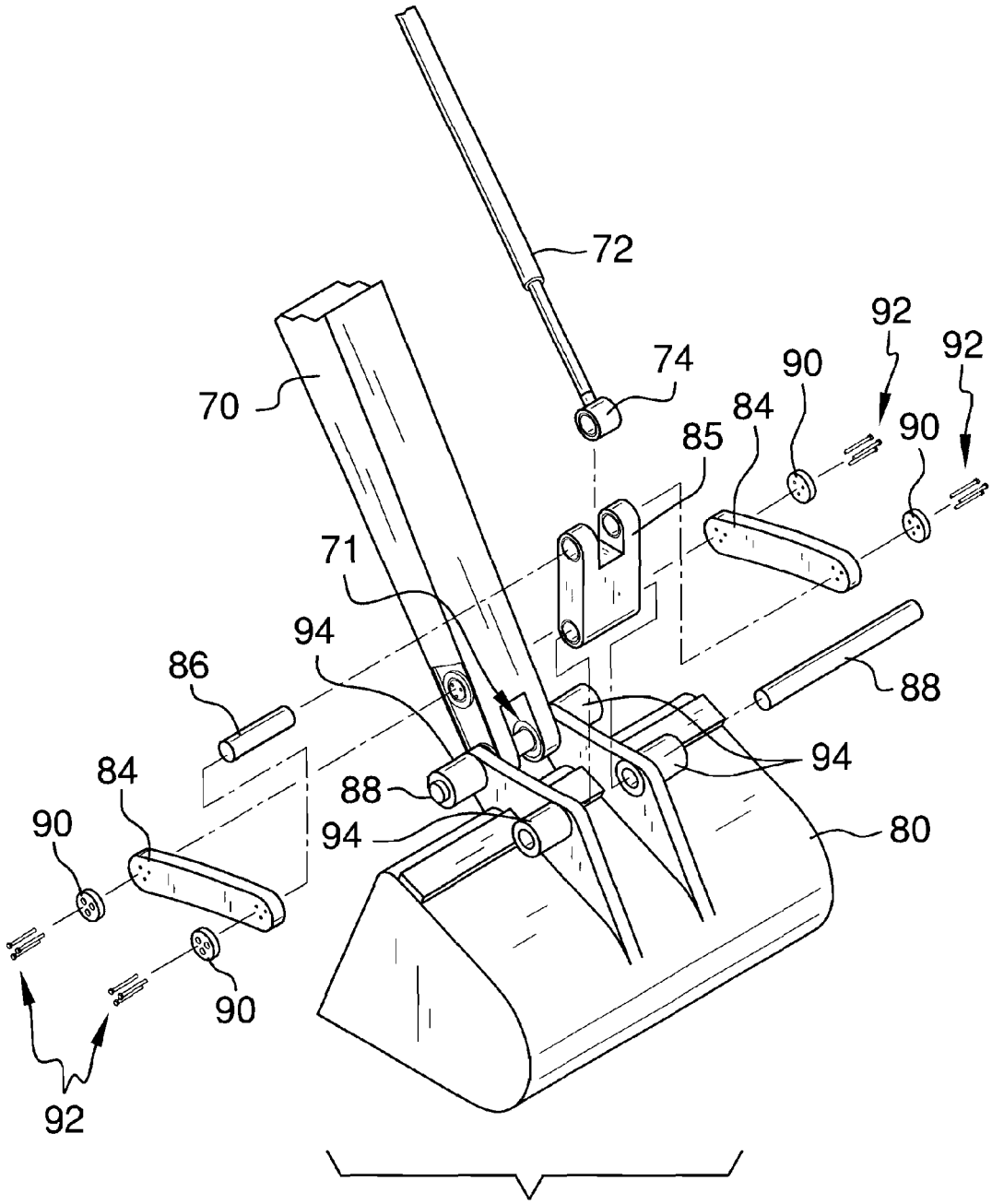
FIG. 2 is an exploded perspective view of FIG. 1.
Figure 3:
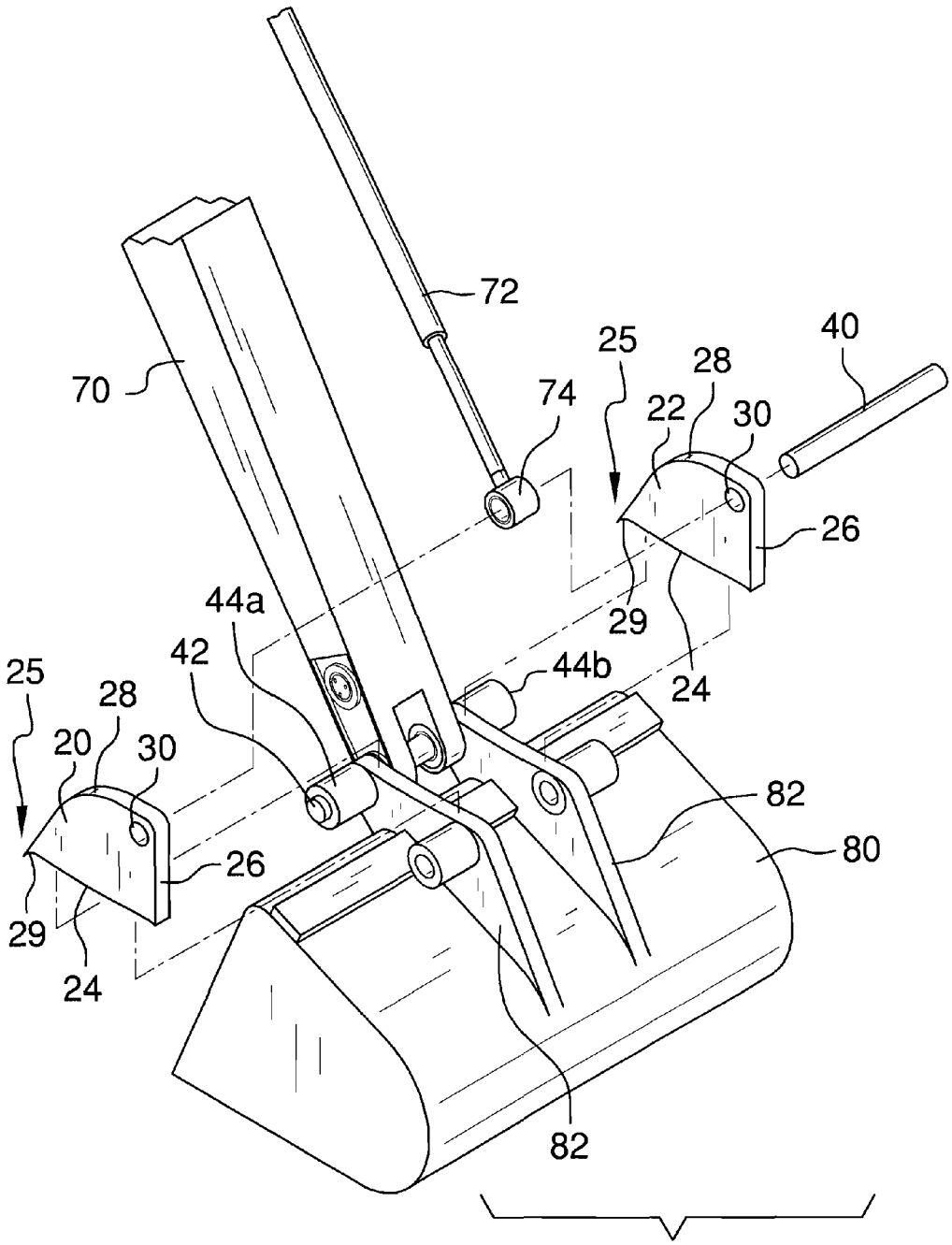
FIG. 3 is an exploded perspective view of the apparatus and an existing bucket, lift arm, and hydraulic cylinder.
Figure 4:
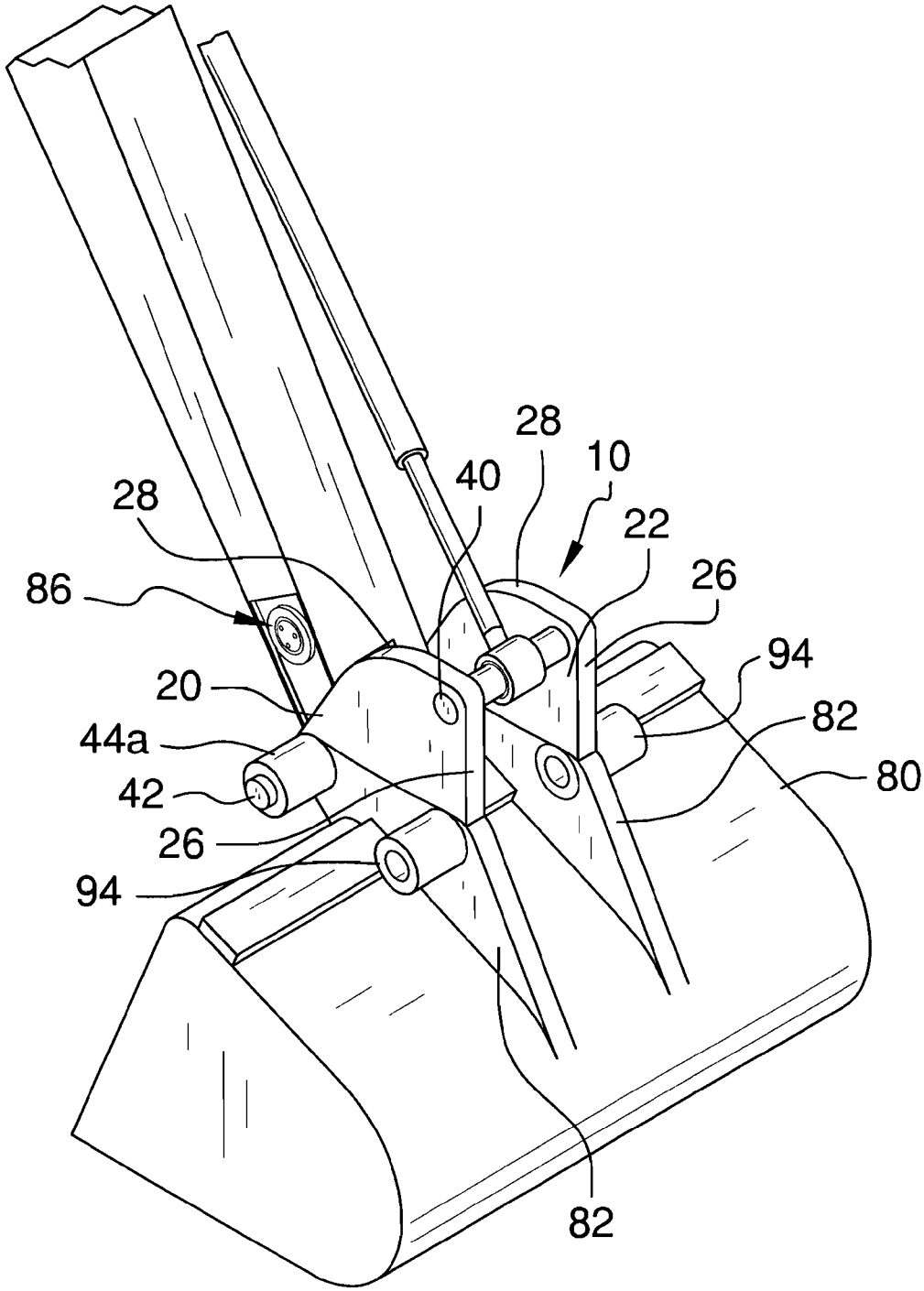
FIG. 4 is a perspective view of FIG. 3, assembled.

With reference now to the drawings, and in particular FIGS. 1 through 4 thereof, the principles and concepts of the excavator bucket attachment apparatus generally designated by the reference number 10 will be described. Referring to FIGS. 3 and 4, the apparatus 10 comprises a pair of identical side members comprising the first side member 20 and the second side member 22. Each side member is welded to one each of an existing pair of bucket extensions 82 of an existing bucket 80. Each identical side member comprises a thickness equal to the thickness of the existing bucket extensions 82. The side members therefore provide the same strength offered by the existing bucket extensions 82. Each side member partially comprises a flat front 26. Each side member further comprises a rounded top 28 extended backwardly from the flat front 26. Each side member further comprises a flat bottom 24 connected to the flat front 26 and the rounded top 28. A cupped tail 29 is disposed at a joining of the rounded top and the flat bottom 24 at the rear 25, the cupped tail 29 pointed slightly downwardly. The cupped tail 29 extends the connected area of each side member to each bucket extension 82. An orifice 30 is disposed proximal to the rounded top 28 and flat front 26 of each side member. The upper pin 40 is inserted through the orifice 30 of each side member. The upper pin 40 is further pivotally inserted through the exiting cylinder sleeve 74 of the existing hydraulic cylinder 72 of an existing excavator. A pair of identical enlarged bushings comprises a first enlarged bushing 44*a* and a second enlarged bushing 44*b*. Each enlarged bushing replaces one each of an existing pair of bushings 94 of the existing bucket extensions 82. The forward existing lower bushings 94 are unused. The enlarged lower pin 42 is pivotally inserted through the enlarged bushings. The enlarged lower pin 42 is further inserted into an existing lower lift arm orifice 71 of the existing lift arm 70 of an existing excavator.

Referring again to FIGS. 3 and 4 and also to FIGS. 1 and 2, the comparative complexity of a typical attachment of a bucket 80 to a lift arm 70 and hydraulic cylinder 72 illustrates the advantages of the current apparatus 10. Four lower bushings 94 along with two existing lower pins 88 provide pivotal attachment of the bucket 80 to the lift arm 70 and to the H-member 85. The bucket 80 and bucket extensions 82 are attached at a rear of the bucket 80 via an existing lower pin 88. A more forward section of the bucket 80 and bucket extensions 82 is attached to the H-member 85 via a second existing lower pin 88. The 2 dog bones 84 are attached to the lift arm 70 and to the H-member 85 via the 2 existing upper pins 86. The retainers 90 and fasteners 92 are required as part of these dog bone 84 attachments. Wear item replacements therefore typically include the existing upper pins 86, the existing lower pins 88, the retainers 90 and fasteners 92, the bushings 94, and the H-member 85.

Referring again to FIGS. 1-4, in use, the modification of an existing bucket 80 of an existing excavator consists of the steps of:

removing the existing lower pins 88 of the existing bucket extensions 82;

eliminating the quartet of bushings 94 of the bucket extensions 82;

disassembling the existing fasteners 92, retainers 90, and dog bones 84 of the existing bucket 80;

extracting the existing upper pins 86 of the H-member 85 and lift arm 70;

taking off the existing H-member 85;

enlarging the existing lower lift arm orifice 71;

installing a pair of spaced apart enlarged bushings to the existing bucket extensions 82, the bushing comprising the first enlarged bushing 44*a* and the second enlarged bushing 44*b;* inserting the enlarged lower pin 42 into the enlarged bushings and the enlarged lower lift arm orifice 71;

installing the upper pin 40 into the side member orifices and the cylinder sleeve 74 of the hydraulic cylinder 72.

With respect to the above description then, it is to be realized that the optimum dimensional relationships for the parts of the excavator bucket attachment apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the excavator bucket attachment apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the excavator bucket attachment apparatus may be used.

Therefore, the foregoing is considered as illustrative only of the principles of the excavator bucket attachment apparatus. Further, since numerous modifications and changes will readily occur to those skilled in the art, it is not desired to limit the excavator bucket attachment apparatus to the exact construction and operation shown and described, and accordingly, all suitable modifications and equivalents may be resorted to, falling within the scope of the excavator bucket attachment apparatus.

What is claimed is:

1. An excavator bucket attachment apparatus, comprising, in combination:

a pair of identical side members comprising a first side member and a second side member, each side member welded to a one each of an existing pair of bucket extensions of an existing bucket, each identical side member comprising:

a thickness equal to a thickness of the existing bucket extensions;

a flat front;

a rounded top;

a flat bottom;

a cupped tail at a joining of the rounded top and a rear of the flat bottom;

an orifice proximal to the rounded top and flat front;

an upper pin inserted through the orifice of each side member, the upper pin further pivotally inserted through an exiting cylinder sleeve of an existing hydraulic cylinder of an existing excavator.

2. An excavator bucket attachment apparatus, comprising, in combination:

a pair of identical side members comprising a first side member and a second side member, each side member welded to a one each of an existing pair of bucket extensions of an existing bucket, each identical side member comprising:

a thickness equal to a thickness of the existing bucket extensions;

a flat front;

a rounded top;

a flat bottom;

a cupped tail at a joining of the rounded top and a rear of the flat bottom;

an orifice proximal to the rounded top and flat front;

an upper pin inserted through the orifice of each side member, the upper pin further pivotally inserted through an exiting cylinder sleeve of an existing hydraulic cylinder of an existing excavator;

a pair of identical enlarged bushings comprising a first enlarged bushing and a second enlarge bushing, each enlarged bushing replacing a one each of an existing pair of bushings of the existing bucket extensions;

an enlarged lower pin pivotally inserted through the enlarged bushings, the enlarged lower pin further inserted into an existing orifice of an existing lift arm of the existing excavator.

3. A method of modifying a bucket attachment of an existing excavator bucket with a excavator bucket attachment apparatus, the apparatus comprising a pair of identical side members comprising a first side member and a second side member, each identical side member comprising a thickness equal to a thickness of an existing pair of bucket extensions, each side member further comprising a flat front, a rounded top, a flat bottom, a cupped tail at a joining of the rounded top and a rear of the flat bottom, an orifice proximal to the rounded top and flat front, the apparatus further comprising an upper pin, a pair of identical enlarged spaced apart bushings comprising a first enlarged bushing and a second enlarged bushing, an enlarged lower pin, wherein the method comprises:

removing a pair of existing lower pins of the pair of existing bucket extensions of the excavator bucket;

eliminating a quartet of existing bushings of the bucket extensions;

disassembling an existing plurality of fasteners, retainers, and dog bones of the excavator bucket;

extracting a pair of existing upper pins of an H-member, a cylinder sleeve of a hydraulic cylinder, and a lift arm of the excavator bucket;

taking off the existing H-member;

enlarging an existing lower lift arm orifice;

installing the pair of spaced apart enlarged bushings to the existing bucket extensions;

inserting the enlarged lower pin into the enlarged bushings and the enlarged lower lift arm orifice;

installing the upper pin into the side member orifices and the cylinder sleeve of the hydraulic cylinder.

* * * * *